US005462458A

United States Patent [19]

Sagawa

[11] Patent Number: 5,462,458

[45] Date of Patent: Oct. 31, 1995

[54] ELECTRICAL CONNECTOR

[75] Inventor: Tetsuya Sagawa, Yamato, Japan

[73] Assignee: The Whitaker Corporation, Wilmington, Del.

[21] Appl. No.: 409,624

[22] Filed: Mar. 23, 1995

Related U.S. Application Data

[63] Continuation of Ser. No. 266,031, Jun. 27, 1994, abandoned.

[30] Foreign Application Priority Data

Aug. 31, 1993 [JP] Japan ..... 5-051940 U

[51] Int. Cl.[6] ..... H01R 13/436

[52] U.S. Cl. ..... 439/752

[58] Field of Search ..... 439/595, 752

[56] References Cited

U.S. PATENT DOCUMENTS 4,772,229 9/1988 Nix et al. ..... 439/733

5,066,252 11/1991 Kato et al. ..... 439/752

5,167,534 12/1992 Ohsumi ..... 439/752

FOREIGN PATENT DOCUMENTS 2248350 4/1992 United Kingdom .

*Primary Examiner*—Gary F. Paumen

*Attorney, Agent, or Firm*—Adrian J. LaRue; Timothy J. Aberle

[57] ABSTRACT

The locking device (50) is inserted from a side surface of the housing (10) to secure contacts and has latching arms (60,62) extending outward from one end. In the position of temporary latching of the locking device, tips (**60*b*,62*b*) of the latching arms project above the surface of flange (26), but they do not extend above the surface in the position of complete latching. Since the width of the latching arms (28,30,32) is almost equal to the width of the guiding grooves made in the flange (26**), the locking device can be moved from the temporary latching position to the complete latching position without skewing relative to the housing.

7 Claims, 5 Drawing Sheets

ELECTRICAL CONNECTOR

This application is a Continuation of application Ser. No. 08/266,031 filed Jun. 27, 1994, now abandoned.

This invention relates to electrical connectors, especially to connectors in which the contacts are secured by a locking device inserted from a side surface of the housing.

BACKGROUND OF THE INVENTION

So-called double-lock connectors in which, for the purpose of securing or reinforcing contacts in insulating housing, two means of securing are provided are widely used in automotive and some other applications. These two means are: housing lances extending from the housing internal wall in the contact cavity (primary means of securing) and a locking device made separately from the housing (secondary means of securing). An example of such a connector is shown in FIG. 5, and its design was proposed by the present applicant JP (1992)-137474. This connector 100 has a locking device 110 which reliably joins the connector and the end insertion piece 112. Because of this, the retention strength of the contacts (not shown in the drawing) is adequately increased, and incompletely inserted contacts can be easily detected.

In the insulating housing 112 of said conventional connector 100, a flange 108 protruding from a side surface 106 of the insulating housing is formed in the vicinity of an insertion opening 104 for the locking device 110. This flange 108 plays the role of the rest for fingers when the connector 110 is pulled out of the matching connector (not shown in the drawing) and, at the same time, it prevents the locking device 110 from useless moving form temporary latched position to the completely latched position.

However, a disadvantage of this design is that in the completely latched position of the locking device 110 becomes flush with the side surface 106, and the flange 108 prevents visual observation of correctness of the position of the locking device 110. It is especially important for harness assembly workers who have to deal with moving the locking device 110 from temporary latched position to fully latched position in the insulating housing 102 after inserting contacts with electric wires connected to them (not shown in the drawing), since they have to look at the connector 100 from the contact insertion side of the insulating housing 102.

In addition, since multiple lugs 114 for complete latching are arranged along the long side of the locking device 110 which is long and narrow, there is a danger that not all lugs 114 lock simultaneously, thus leaving the locking device 110 inclined relative to the side surface 106 of the insulating housing 102. Therefore, there is a danger that the locking device 110 in automotive harness will be incompletely attached since it is difficult to check the position of the locking device 110 by looking from the contact insertion side of the insulating housing 102.

Therefore, the purpose of this invention was to offer a connector free of the above mentioned disadvantages, that is to prevent inclined position of the locking device inserted from a side of the insulating housing and to provide visual means for checking completeness of the latching by the locking device.

SUMMARY OF THE INVENTION

The connector according to this invention consists of multiple contacts, an insulating housing having multiple contact receiving cavities into which said contacts are inserted from one end of the housing, and a locking device inserted from a side surface of said insulating housing, and having multiple latching arms formed in said locking device along its long side which are inserted in a guiding groove made in the flange formed at one end of the above mentioned insulating housing, is characterized by the fact that the tips of the latching arms extend from said flange during temporary locking of the above mentioned locking device, but do not protrude when the locking is completed.

Since multiple latching arms formed in the locking device are guided by the guiding groove made in the flange of the insulating housing, the locking device is moved from the temporary latched position to the completely latched position without skew relative to the insulating housing.

In addition, since in the temporary latched position the tips of the latching arms extend from the flange of the insulating housing and do not protrude therefrom in the completely latched position, they provide an easy means for checking the status of the locking device while looking from the contact insertion side of the insulating housing.

Below, we will give detailed explanations, with reference to the drawings, concerning the preferred embodiment of the connector according to this invention. FIGS. 1A–1C is a drawing showing an insulating housing 10 used in one of the embodiments of the connector according to this invention. FIGS. 2A–2D is a locking device 50 inserted in the insulating housing 50 shown in FIGS. 1A–1C. The connector consists of the insulating housing 10 shown in FIGS. 1A–1C, the locking device 50 shown in FIGS. 2A–2D and multiple contacts shown by double-dot-and-dash lines in FIG. 3. There is no special limitations regarding the contacts, but it is preferable to use female-type contacts described in the JP(1992)-137474.

DETAILED DESCRIPTION OF THE INVENTION

Figure 1A:
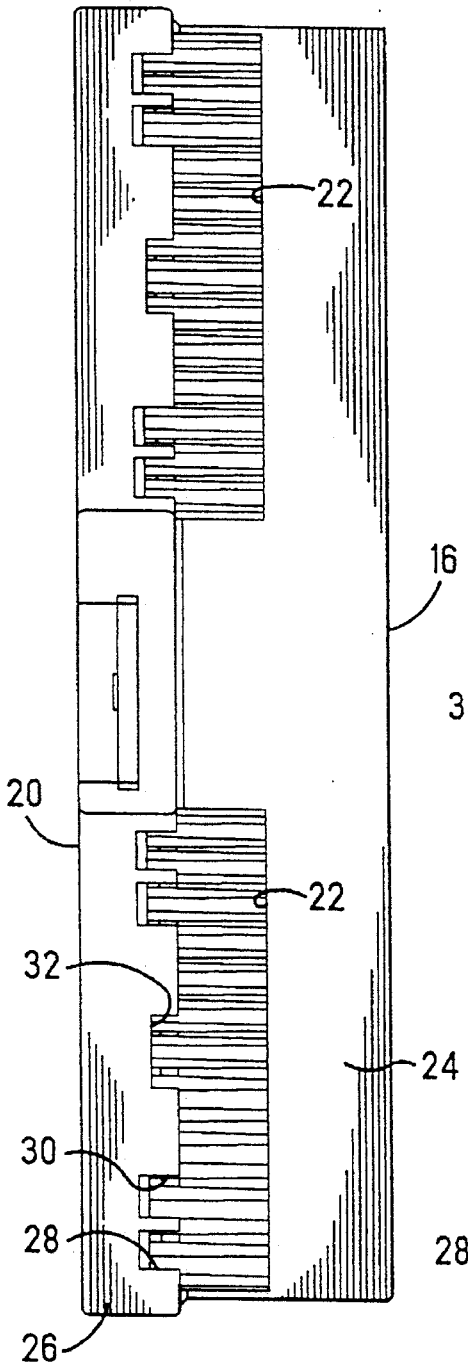
FIGS. 1A–1C show an insulating housing of one embodiment of the connector according to this invention: 1A is a plan view; B is a front view; and 1C shows a side view.
Figure 1B:
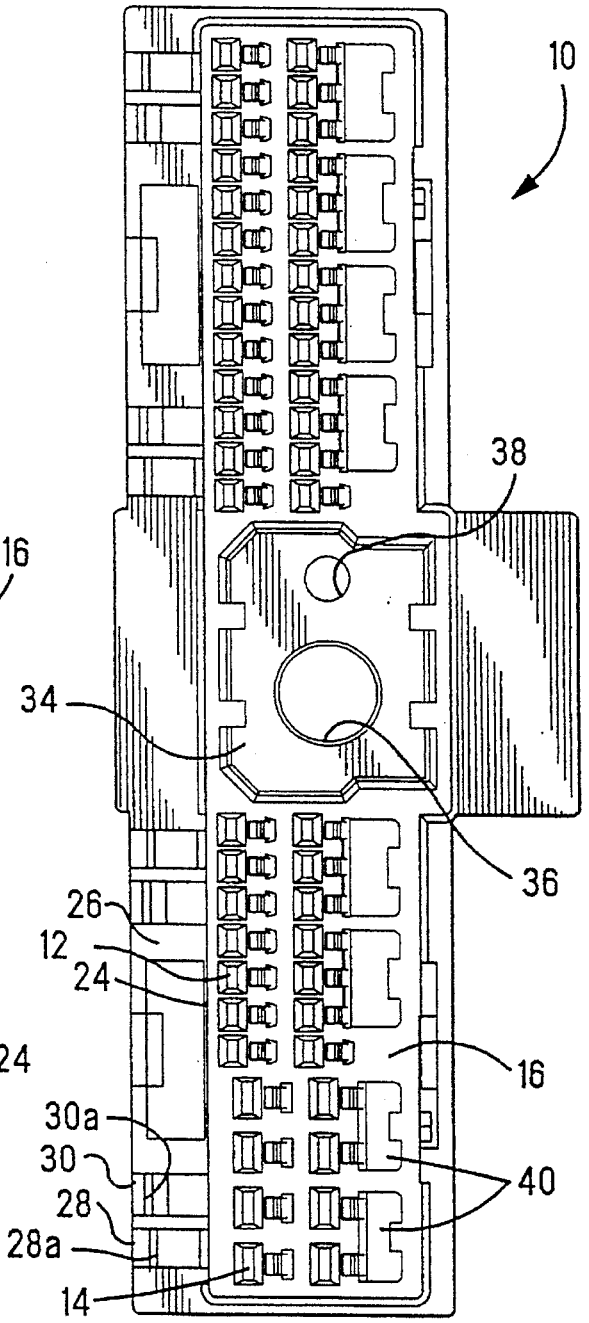
Figure 1C:
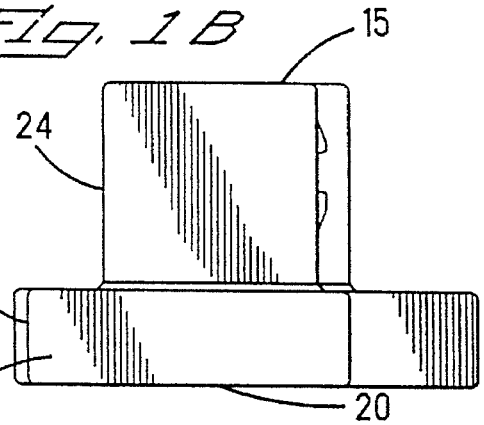
Figure 2A:
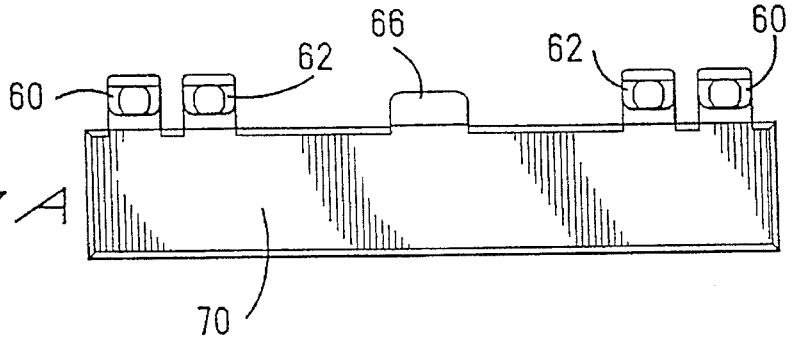
FIG. 2A–2D show a locking device inserted in the insulating housing of FIG. 1: 2A is a plan view; 2B is a front view; 2C is a side view; and D is a back view.
Figure 2C:
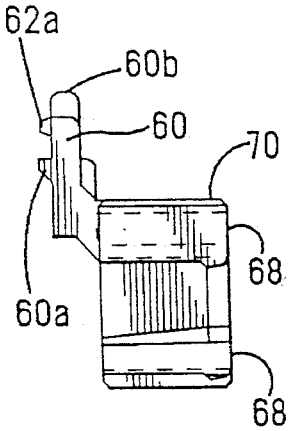
Figure 2B:
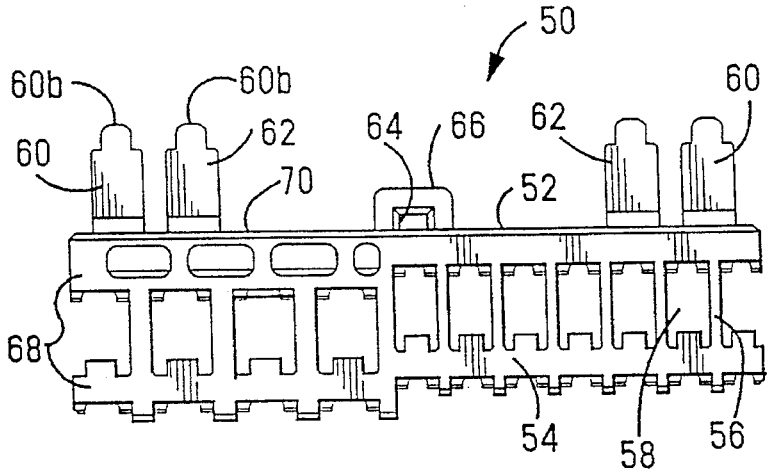
Figure 2D:
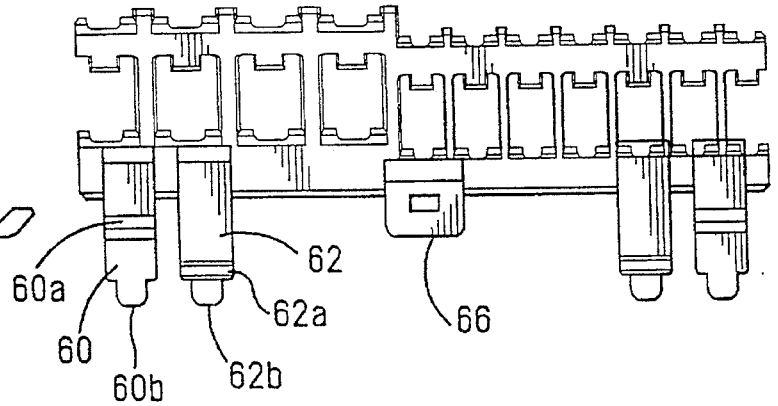

FIGS. 1A–1C represent a plug-type insulating housing 10 made of PBT resin or other suitable insulating material comprising the matching end 16 in which insertion openings 12, 14 are formed for contacts of a matching connector (not shown in the drawing), a contact insertion end 20 in which insertion openings 18 (FIG. 3) are formed for female-type contacts (FIG. 3) and a side surface 24 with an insertion opening 22 for the locking device 50 formed in it. On the side surface 24 at the contact insertion end 20, a flange 26 is formed extending from the side surface 24. In this flange 26, a number of grooves 28, 30, 32 is formed which are connected with the insertion opening 22 for the locking device. Among these grooves, grooves 28 and 30 are guiding grooves for the latching arms 60, 62 (FIGS. 2A–2D) (to be discussed below) of the locking device 50, and they have stoppers 28*a* and 30*a* made at slightly different locations. The groove 32 is provided for the insertion of a protrusion 66 having an opening 64 for the insertion of a tool (to be discussed below). At the center of the matching surface 16 of the insulating housing 10, a depression 34 is formed for reception of a nut (not shown in the drawing) of the matching connector, in its bottom surface, a bolt insertion opening 36 and an indicator insertion opening 38 are made. Next to the row of openings 12, 14 for the contacts of the matching connector, a number of openings 40 are made. Their purpose is to accept lugs (not shown in the drawing) of the matching connector preventing misalignment of the connectors to be joined.

Figure 3:
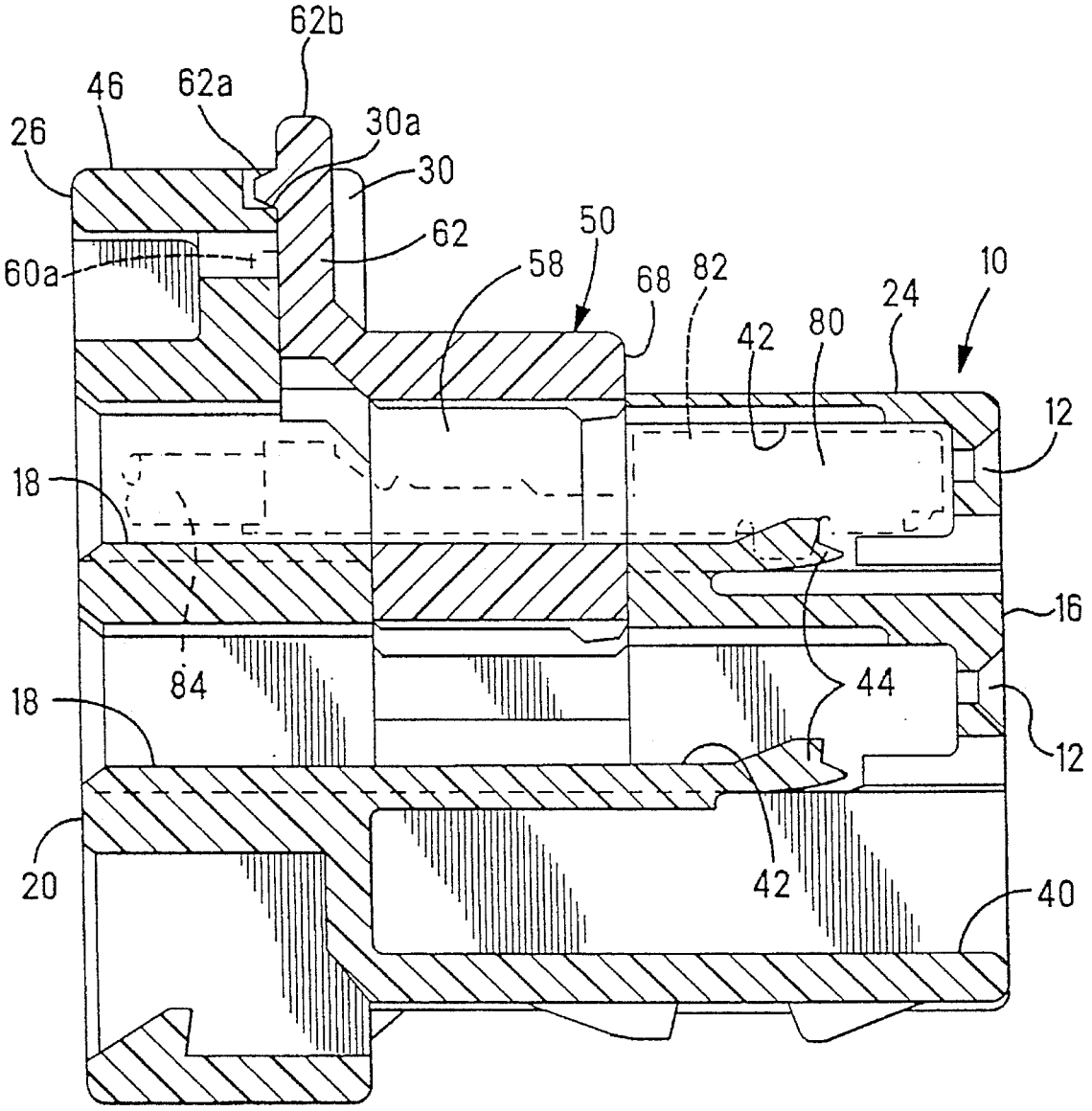
FIG. 3 shows a cross section of the locking device shown in FIG. 2 and the insulating housing shown in FIG. 1 in the temporary latching position.

As can be seen in FIGS. 2A–2D, partitions 56 made along the long side of the locking device 50 between its base 52 and the insertion end 54 form a ladder-like structure. Through holes 58 formed by partitions 56, base 52 and the insertion end 54 correspond to the openings 18 for the insertion of the female-type contacts formed at the other end of the insulating housing 10. The intersections of dot-and-dash lines indicated approximate positions of the centers of the female-type contacts 80 (FIG. 3). Near the ends of the base 52, latching arms 60, 62 are formed extending outward in the same direction. These latching arms 60 have lugs 60a for temporary latching, and latching arms 62 have lugs 62a for full latching, which are located at different positions. In the middle of the base 52, a protrusion 66 is made having an opening 64 for the insertion of a screw driver or other tool for removal of the locking device 50 from the insulating housing 10.

Figure 4:
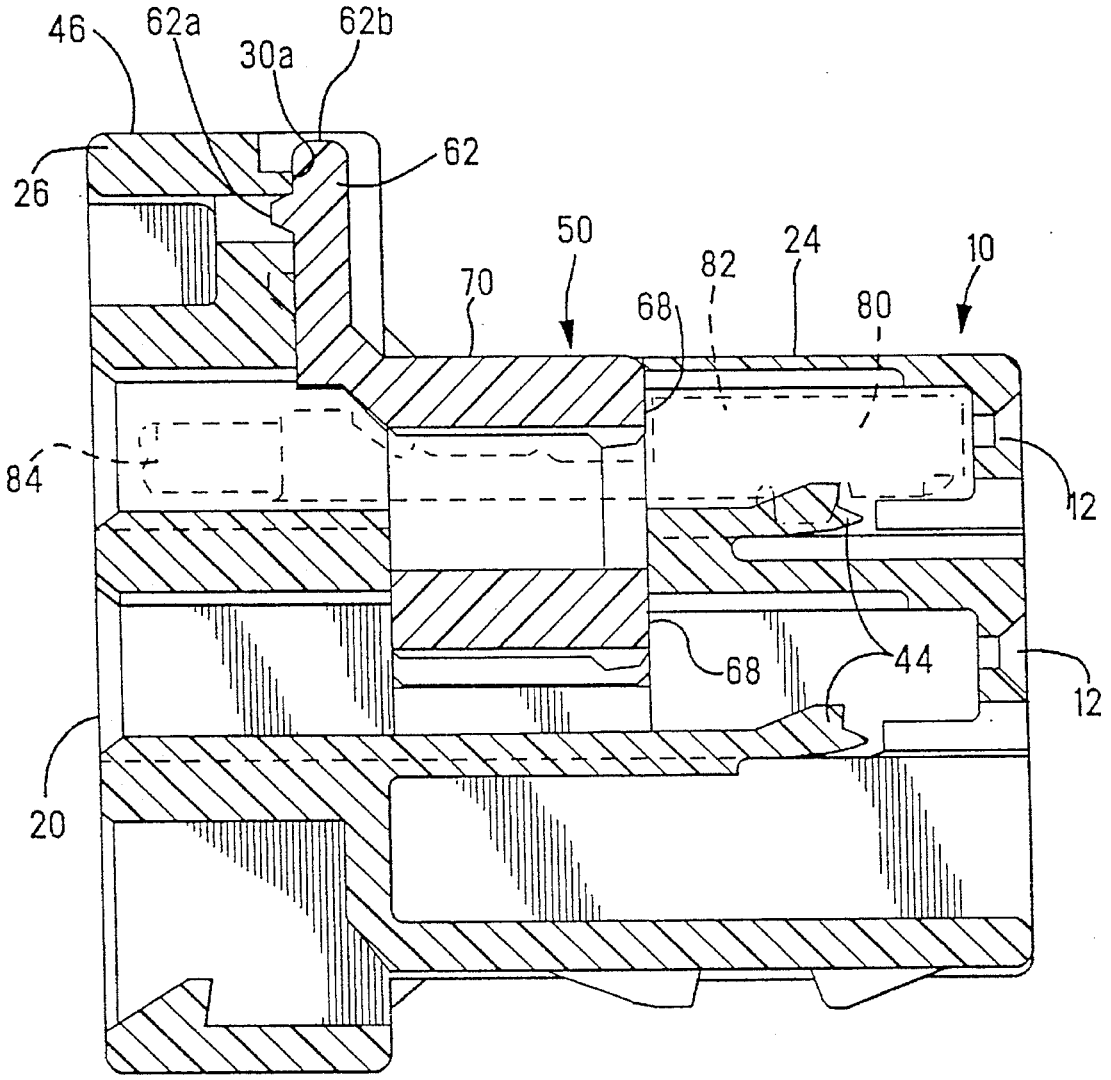
FIG. 4 shows the connector of FIG. 3, but in the complete latching position.
Figure 5:
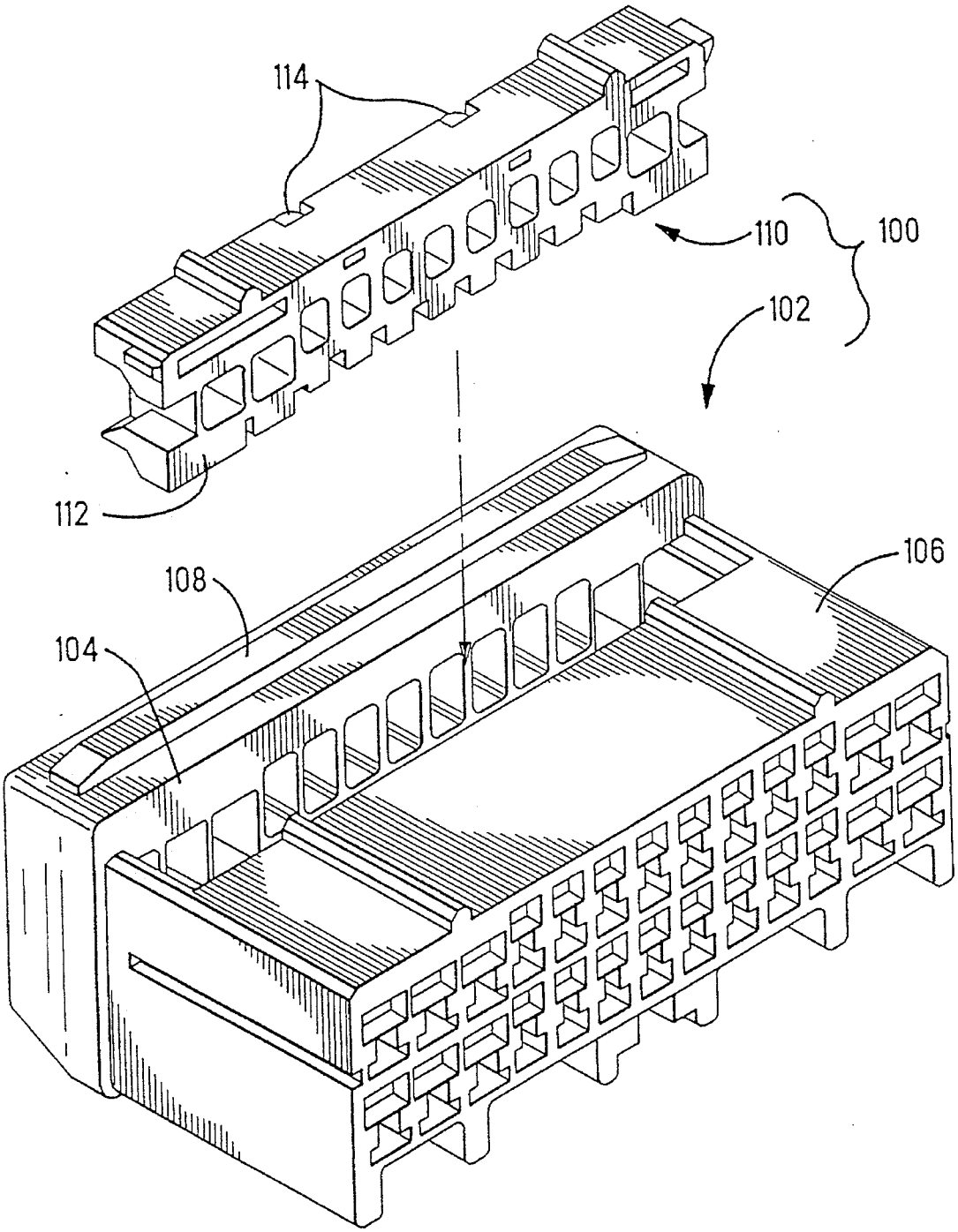
Fig. 5 PRIOR ART
FIG. 5 shows an oblique exploded view of a conventional connector.

FIG. 3 is a cross section of an assembly of the housing 10 and the locking device 50 in the position of temporary latching. FIG. 4 is a cross section of an assembly of the housing 10 and the locking device 50 in the position of complete latching. In FIG. 3 showing the locking device 50 in the position of complete latching, through holes 58 of the locking device 50, insertion openings 18 for the female-type contacts of the insulating housing 10 and the contact receiving cavities 42 are aligned, which makes it possible to insert female-type contacts 80 shown here by two-dot-and-dash lines. Fully inserted female contacts 80 become engaged with springy arms 44 extending from the inside wall of the contact-receiving cavity 42 (primary latching).

In the position of temporary latching of the locking device 50, lug 60*a* of the latching arm 60 which prevents extraction interacts with a stopper 28*a* (FIG. 1) of the groove 28 of the insulating housing 10, thus preventing the locking device 50 from being pulled out. A complete latching stopper 62*a* of the latching arm 62 interacts with the stopper 30*a* of the groove 30, thus preventing unnecessary movement of the locking device 50 from the temporary latching position to the position of complete latching. Length of the latching arms 60 and 62 is selected in such a way that their tips 60*b* and 62*b* are projected above the surface 46 of the flange 26. Therefore, the position of the locking device 50 can be easily detected, especially when looking from the side of the contact insertion end 20. The detection of a mutual position can be further facilitated by making the housing 10 and the locking device 50 of different colors, for example, housing 10 black, and the locking device 50 white.

As can be seen in the FIG. 4 showing the locking device 50 in a completely latched position, locking surface 68 of the locking device 50 comes in contact with the connecting sections 82 of the female-type contacts 80, and, together with the springy arms 44, it secures the contacts 80 (secondary latching). In this position of complete latching, complete latching stoppers 62*a* of the latching arms 62 become engaged with the stopper 30*a* of the groove 30, thus preventing extraction of the locking device 50. In addition, since in the position of complete latching, tips 60*b* and 62*b* of the latching arms 60 and 62 do not project above the surface 46 of the flange 26, it is easy to detect if the locking device 50 is in a completely latched position, especially when looking from the side of the contact insertion end 20. Therefore, it makes it easier for assembly workers to determine position of the locking device when inserting contacts 80 with attached electrical wires 84 into housing 10.

Looking again at the FIGS. 2A–2D, we can see that the latching arms 60, 62 are made relatively long and, at the same time, their width is almost equal to that of the grooves 28, 30 of the housing 10. Because of that, the latching arms 60, 62 are guided by grooves 28, 30 when the locking device 50 is moved from the position of temporary latching to the position of complete latching. Therefore, if an attempt is made to move the locking device 50 to the position of complete latching by pushing at only one end, the interaction of the latching arms 60, 62 and the grooves 28, 30 will prevent skewness of the locking device 50 by making the above movement difficult. This results in the fact that the only possible movement of the locking device 50 is when its outside surface 70 is parallel to the side surface 24 of the housing 10.

Above, we gave detailed explanations concerning the preferred embodiment of the connector according to this invention, however this invention is not limited only to the embodiment discussed above, but also includes various modifications made as necessary. For example, the connector may be a receptacle connector rather than a plug connector, and the contacts may be of male type or female/male type rather than female type. The housing may be equipped with springy arms or may be made without them.

Based on this invention, we can obtain a connector in which movement of the locking device inserted from a side surface of the housing from the temporary latching position to the complete latching position takes place without skewness, and the state of the complete latching position of the locking device can be easily ascertained visually. Therefore, the percentage of poor quality automotive electric harness can be drastically reduced.

I claim:

1. An electrical connector comprising:

an insulating housing having multiple contact receiving cavities into which the contacts are inserted in a longitudinal direction from an end of the housing, and a locking device inserted from a side surface of said insulating housing in a lateral direction into an aperture formed in said housing;

multiple latching arms formed in said locking device which are inserted in respective guiding grooves made in a flange formed at one end of the insulating housing;

characterized by the fact that tips formed on free ends of the latching arms extend laterally beyond said flange during temporary locking of the locking device, but said tips do not extend beyond said flange when the locking device is in a fully inserted position.

2. The electrical connector of claim 1, wherein the latching arms include lugs for temporary latching and lugs for full latching of the latching device.

3. The electrical connector of claim 1, wherein said grooves include stoppers for receiving lugs formed on said locking arms.

4. The electrical connector of claim 3, wherein the lugs are formed in a staggered arrangement on said latching arms.

5. The electrical connector of claim 4, wherein the lugs include tapered surfaces for deflecting said tips when said lugs are passing over said stoppers.

6. An electrical connector comprising:

an insulating housing having multiple contact-receiving cavities into which the contacts are inserted in a longitudinal direction from an end of the housing;

a locking device inserted from a side surface of said housing in a lateral direction into an aperture located in said housing;

multiple latching arms on said locking device disposed along respective guiding grooves in a flange of said housing in communication with said aperture;

lugs on said multiple latching arms for temporarily latching said locking device in a first position and for fully latching said locking device in a second position.

7. An electrical connector as claimed in claim 6, wherein said grooves include stoppers for receiving said lugs.

* * * * *

UNITED STATES PATENT AND TRADEMARK OFFICE

CERTIFICATE OF CORRECTION

PATENT NO. : 5,462,458

DATED : October 31, 1995

INVENTOR(S) : Tetsuya Sagawa

It is certified that error appears in the above-indentified patent and that said Letters Patent is hereby corrected as shown below:

Column 4:

Claim 2, line 63, "latching" (Second occurrence) should be --locking--.

Claim 3, line 66, "locking" should be --latching--.

Signed and Sealed this

Twenty-third Day of April, 1996

Bruce Lehman

*Attest:*

BRUCE LEHMAN

*Attesting Officer*

*Commissioner of Patents and Trademarks*